United States Patent [19]

Fujii et al.

[11] Patent Number: 4,969,426

[45] Date of Patent: Nov. 13, 1990

[54] VALVE OPERATING MECHANISM FOR INTERNAL COMBUSTION ENGINE

[75] Inventors: Noriaki Fujii; Takeshi Iwata; Naoki Takahara, all of Saitama, Japan

[73] Assignee: Honda Giken Kogyo Kabushiki Kaisha, Tokyo, Japan

[21] Appl. No.: 300,735

[22] Filed: Jan. 19, 1989

Related U.S. Application Data

[63] Continuation of Ser. No. 71,732, Jul. 9, 1987, abandoned.

[30] Foreign Application Priority Data

Jul. 9, 1986 [JP] Japan ..... 61-162857

[51] Int. Cl.[5] ..... F01L 1/26

[52] U.S. Cl. ..... 123/90.23; 123/90.27; 123/90.44

[58] Field of Search ..... 123/90.27, 90.44, 193 H, 123/90.39, 90.23, 328, 315, 432

[56] References Cited

U.S. PATENT DOCUMENTS

| | | | |
|---|---|---|---|
| 3,219,019 | 11/1965 | Palmer | 123/90.27 |
| 4,553,515 | 11/1985 | King et al. | 123/193 H |
| 4,561,391 | 12/1985 | Simko | 123/90.39 |
| 4,662,323 | 5/1987 | Moriya | 123/90.23 |

FOREIGN PATENT DOCUMENTS

| | | | |
|---|---|---|---|
| 0783318 | 7/1935 | France | 123/90.27 |
| 0851081 | 1/1940 | France | 123/90.27 |
| 56-143322 | 11/1980 | Japan . | |
| 0035106 | 2/1985 | Japan | 123/90.23 |
| 0178910 | 9/1985 | Japan | 123/90.39 |
| 1331226 | 9/1973 | United Kingdom . | |

*Primary Examiner*—Willis R. Wolfe
*Assistant Examiner*—M. Macy
*Attorney, Agent, or Firm*—Lyon & Lyon

[57] ABSTRACT

An internal combustion engine includes a cylinder block having a cylinder bore, a cylinder head having a combustion chamber communicating with the cylinder bore, a spark plug supported in the cylinder head and having electrodes disposed in the combustion chamber, two first valves supported on the cylinder head and having valve head disposed in one side of the combustion chamber, and two second valves supported on the cylinder head and having valve heads disposed in an opposite side of the combustion chamber. A valve operating mechanism associated with the internal combustion engine comprises a camshaft rotatably mounted on the cylinder head and engaging the first valves for operating the first valves, a rocker arm holder mounted on the cylinder head, a rocker arm shaft or shafts disposed between the camshaft and the second valves and rotatably supported by the rocker arm holder, and two rocker arms swingably mounted on the rocker arm shaft or shafts and held in engagement with the camshaft and the second valves for operating the second valves. The rocker arm holder is disposed above the cylinder bore in substantial central alignment therewith, the rocker arm holder having a plug insertion hole for insertion of the spark plug therethrough.

16 Claims, 8 Drawing Sheets

VALVE OPERATING MECHANISM FOR INTERNAL COMBUSTION ENGINE

This application is a continuation of application Ser. No. 071,732, filed 7/9/87, now abandoned.

BACKGROUND OF THE INVENTION

1. Field of the Invention

The present invention relates to a valve operating mechanism of the SOHC (single overhead camshaft) type for an internal combustion engine.

2. Description of the Relevant Art

There is known an SOHC valve operating mechanism in an internal combustion engine having cylinder bores each associated with a combustion chamber thereabove which has an ignition spark plug. Two intake valves are disposed in one side of each combustion chamber, and two exhaust valves are disposed in the other side of the combustion chamber. The valve operating mechanism includes a single camshaft extending above the cylinder head and positioned at the upper ends of the intake or exhaust valves, a rocker arm shaft disposed between the camshaft and the other valves, and rocker arms held in engagement with the camshaft and swingable about the rocker arm shaft. The upper ends of the intake or exhaust valves are engaged by the camshaft so that they can be opened and closed when the camshaft is rotated about its own axis. The upper ends of the other valves are engaged by the rocker arms and openable and closable by swinging movement of the rocker arms caused by rotation of the camshaft. The valve operating mechanism of this design is disclosed in Japanese Laid-Open Patent Publication No. 56-143322, for example.

For suppressing knocking and increasing combustion efficiency in the internal combustion engine equipped with the valve operating mechanism of the 4-valve SOHC type, it is desirable to position the spark plug at the center of the combustion chamber. However, if the spark plug were located centrally in the combustion chamber, the width and height of the cylinder head would be of increased values to prevent the spark plug from interfering with components of the valve operating mechanism upon insertion of the plug into the combustion chamber. Use of a member having a plug insertion hole on the cylinder head would result in an increased number of parts required for making up the valve operating mechanism.

SUMMARY OF THE INVENTION

In view of the aforesaid drawbacks of the conventional valve operating mechanism, it is an object of the present invention to provide a valve operating mechanism of the 4-valve SOHC type which allows an ignition spark plug to be located centrally in a combustion chamber while keeping the cylinder head compact in shape and without increasing the number of parts used.

According to the present invention, the above object can be achieved by a valve operating mechanism in an internal combustion engine including a cylinder block having a cylinder bore, a cylinder head having a combustion chamber communicating with the cylinder bore, a spark plug supported in the cylinder head and having electrodes disposed in the combustion chamber, two first valves supported on the cylinder head and having valve heads disposed in one side of the combustion chamber, and two second valves supported on the cylinder head and having valve heads disposed in an opposite side of the combustion chamber, the valve operating mechanism comprising a camshaft rotatably mounted on the cylinder head and engaging the first valves for operating the first valves, a rocker arm holder mounted on the cylinder head, rocker arm shaft means disposed between the camshaft and the second valves and rotatably supported by the rocker arm holder, and two rocker arms swingably mounted on the rocker arm shaft means and held in engagement with the camshaft and the second valves for operating the second valves, the rocker arm holder being disposed above the cylinder bore in substantial central alignment therewith, the rocker arm holder having a plug insertion hole for insertion of the spark plug therethrough.

The above and further objects, details and advantages of the present invention will become apparent from the following detailed description of preferred embodiments thereof, when read in conjunction with the accompanying drawings.

DETAILED DESCRIPTION OF THE PREFERRED EMBODIMENTS

Figure 1:
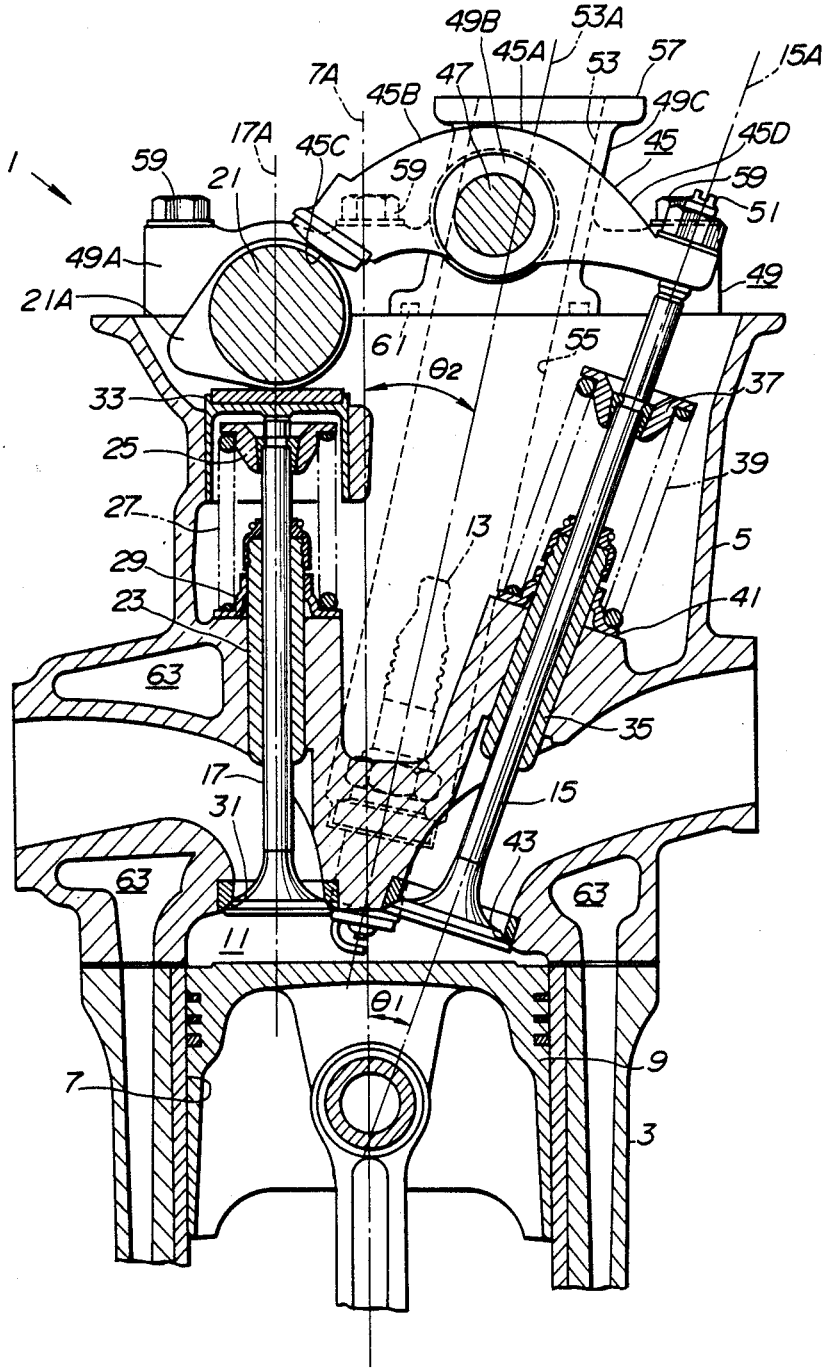
FIG. 1 is a vertical cross-sectional view of an engine cylinder head associated with a valve operating mechanism according to a first embodiment of the present invention.

Like or corresponding parts are denoted by like or corresponding reference characters throughout the views.

Figure 2:
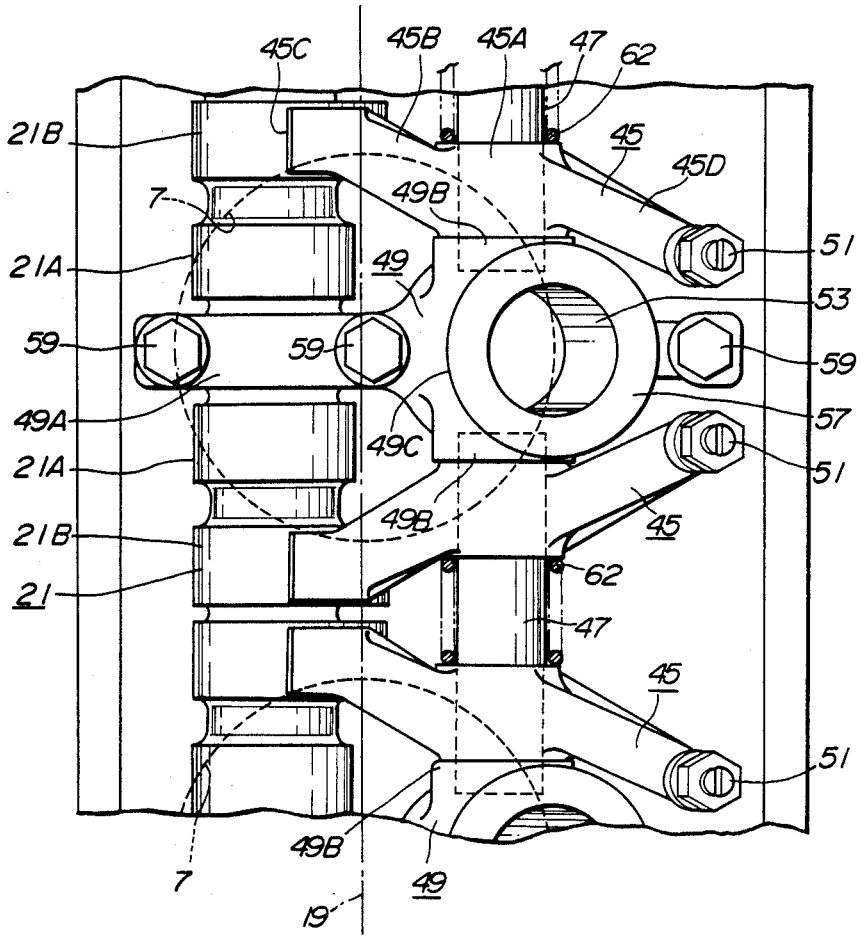
FIG. 2 is a fragmentary plan view of the valve operating mechanism shown in FIG. 1.

FIGS. 1 and 2 show a valve operating mechanism according to a first embodiment of the present invention. The valve operating mechanism is associated with a water-cooled four-cylinder internal combustion engine 1 having a cylinder block 3 and a cylinder head 5 mounted on the cylinder block 3. The cylinder block 3 has four aligned cylinder bores 7 in which pistons 9 are slidably disposed, respectively. The cylinder head 5 has combustion chambers 11 defined in its lower portion and held in communication with the cylinder bores 7, respectively. An ignition spark plug 13 is mounted on the cylinder head 5 and has its electrodes located in each of the combustion chambers 11. Two intake valves 15 and two exhaust valves 17 are also slidably supported on the cylinder head 5 and have their valve heads facing into the combustion chamber 11.

The valve operating mechanism has a single camshaft 21 rotatably supported on the cylinder head 5 and positioned on one side of a central axis 7A of the cylinder bores 7. The camshaft 21 extends parallel to the direction indicated at 19 along which the cylinder bores 7 are aligned.

The exhaust valves 17 are displaced laterally to one side from the central axis 7A and have their axes 17A extending vertically parallel to the central bore axis 7A between the combustion chamber 11 and the camshaft 21.

Each of the exhaust valves 17 is slidably supported by a valve guide 23 in the cylinder head 5 and is normally urged to close an exhaust port 31 by a valve spring 27 disposed between a spring retainer 25 and a spring seat 29. A tappet 33 disposed on the upper end of the exhaust valve 17 is held in engagement with an exhaust-valve cam 21A on the camshaft 21. Thus, the exhaust valves 17 are directly operated by the camshaft 21 upon rotation thereof for opening and closing the exhaust ports 31.

A cooling water jacket 63 is provided in the cylinder head and has a portion surrounding the exhaust gas passage on the outside of the exhaust valve 17, as shown in FIG. 1.

The intake valves 15 are displaced laterally to the opposite side from the central bore axis 7A and have their axes 15A inclined at an angle $\theta 1$ with respect to the central bore axis 7A.

Each of the intake valves 15 is slidably supported by a valve guide 35 in the cylinder head 5 and is normally urged to close an intake port 43 by a valve spring 39 disposed between a spring retainer 37 and a spring seat 41. The intake valves 15 are operated to open and close the intake ports 43 by two rocker arms 45 held in engagement with the camshaft 21.

Each of the rocker arms 45 is swingably supported on a rocker arm shaft 47 extending parallel to the direction 19 and disposed between the camshaft 21 and the upper end of the intake valve 15. The rocker arm shaft 47 is supported by rocker arm holders 49.

Each of the rocker arm holders 49 is mounted on the cylinder head 5 above the cylinder bore 7 and has its center substantially aligned with the center of the cylinder bore 7 in the direction 19. The rocker arm holder 49 is positioned between the two rocker arms 45.

Each rocker arm 45 has a longitudinal central portion 45A supported on the rocker arm shaft 47. The rocker arm 45 includes a slipper surface 45C on the distal end of an arm portion 45B extending from the central portion 45A toward the camshaft 21, the slipper surface 45C being held in slidable contact with an intake-valve cam 21B of the camshaft 21. The rocker arm 45 also includes an arm portion 45D extending from the central portion 45A remotely from the arm portion 45B and supporting thereon an adjustment screw 51 engaging the upper end of the intake valve 15. Consequently, upon rotation of the camshaft 21, the intake valves 15 are operated by the respective rocker arms 45 to open and close the intake ports 43.

Each rocker arm holder 49 comprises a bearing 49A having a semicircular bearing surface by which a journal of the camshaft 21 is rotatably supported, a pair of bearings 49B having annular bearing surfaces by which the rocker arm shaft 47 is rotatably supported, and a tubular member 49C extending vertically and disposed between the bearings 49B and having a plug insertion hole 53 defined therethrough for insertion of the spark plug 13 therethrough.

The plug insertion hole 53 has its axis 53A inclined at an angle $\theta 2$ from the central bore axis 7A toward the intake valve 15. The plug insertion hole 53 is contiguous to a plug insertion hole 55 defined in the cylinder head 5 and extending toward the center of the combustion chamber 11. The tubular member 49C has a flange 57 on its upper end.

The rocker arm holder 49 is fastened to the cylinder head 5 by bolts 59 at opposite sides of the bearing 49A and at an outer side of the tubular member 49C.

The spark plug 13 can be inserted through the plug insertion holes 53, 55 and secured to the cylinder head 5 substantially centrally of the combustion chamber 11. A seal member 61 is disposed on the lower surface of the rocker arm holder 49 and around the plug insertion hole 53.

There are a plurality of rocker arm shafts 47 held in coaxial relation to each other as shown in FIG. 2. Each of the rocker arm shafts 47 is of a short length, i.e., the confronting ends of adjacent rocker arm shafts 47 are spaced from each other with the plug insertion hole 53 defined between the bearings 49B. The opposite ends of each of the rocker arm shafts 47 are rotatably supported in the respective confronting bearings 49B of adjacent rocker arm holders 49 which are located above adjacent cylinder bores 7.

A coil spring 62 is disposed around each of the rocker arm shafts 47 for normally urging the rocker arms 45 to move toward the bearings 49B thereby to position the rocker arms 45.

As described above, the rocker arm holder 49 with the plug insertion hole 53 defined therein is disposed on the cylinder head 5 above the cylinder bore 7 in substantially central alignment therewith. With this arrangement, the spark plug 13 can be positioned substantially centrally of the combustion chamber 11 while keeping the cylinder head 5 compact and without increasing the number of parts required.

Figure 3:
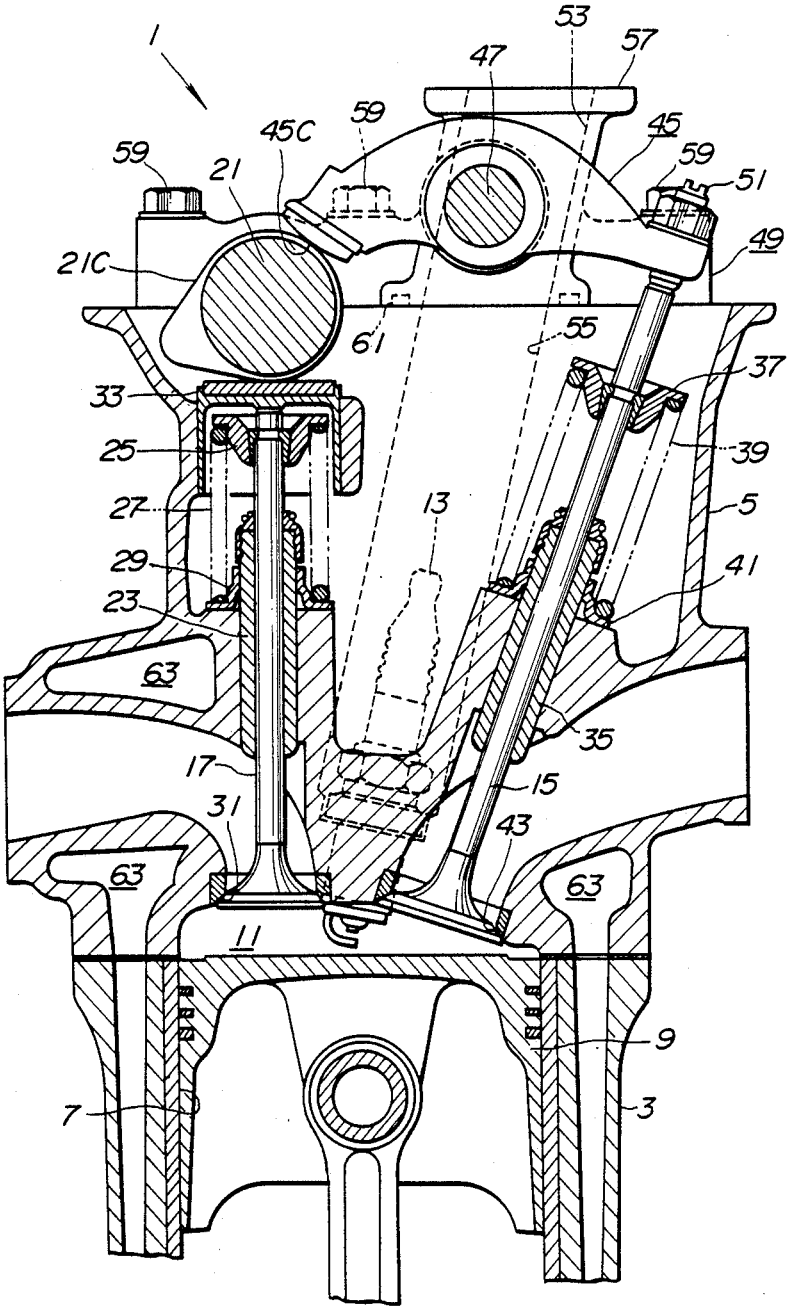
FIG. 3 is a vertical cross-sectional view of an engine cylinder head associated with a valve operating mechanism according to a second embodiment of the present invention.
Figure 4:
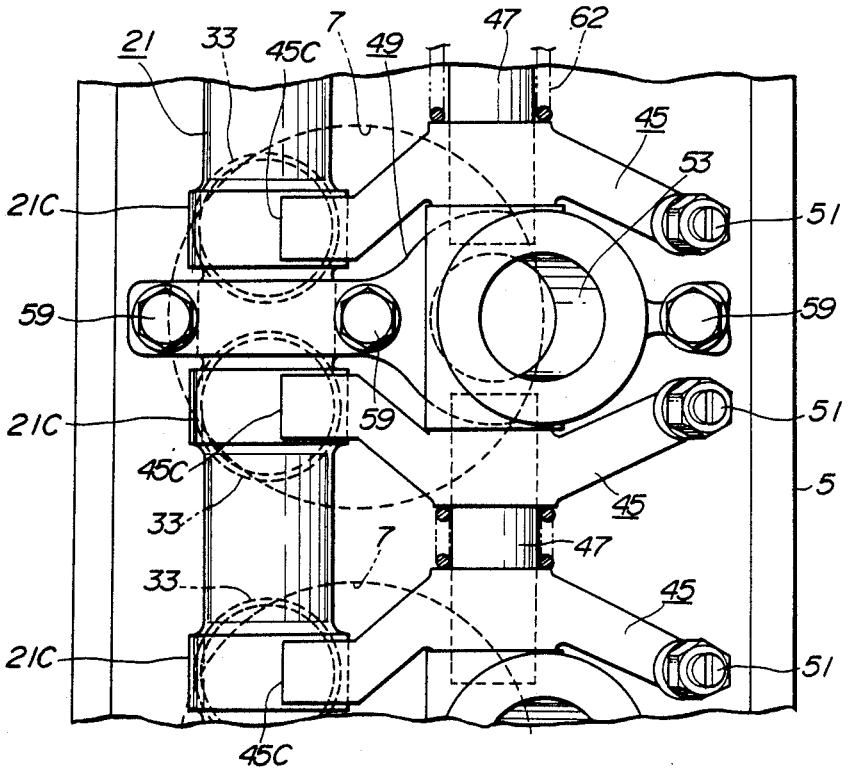
FIG. 4 is a fragmentary plan view of the valve operating mechanism shown in FIG. 3.

A valve operating mechanism according to a second embodiment of the present invention will be described with reference to FIGS. 3 and 4.

The valve operating mechanism of the second embodiment differs from that of the first embodiment in that the tappet 33 and the slipper surface 45C of the rocker arm 45 are held in engagement with a single cam 21C of the camshaft 21, so that the exhaust valve 17 and the intake valve 15 can be opened and closed by the single cam 21C.

As is the case with the first embodiment, the rocker arm holder 49 with the plug insertion hole 53 defined therein is disposed on the cylinder head 5 above the cylinder bore 7 substantially at its center, for thereby allowing the spark plug 13 to be positioned substantially centrally of the combustion chamber 11 while keeping the cylinder head 5 compact and without increasing the number of parts required.

Figure 5:
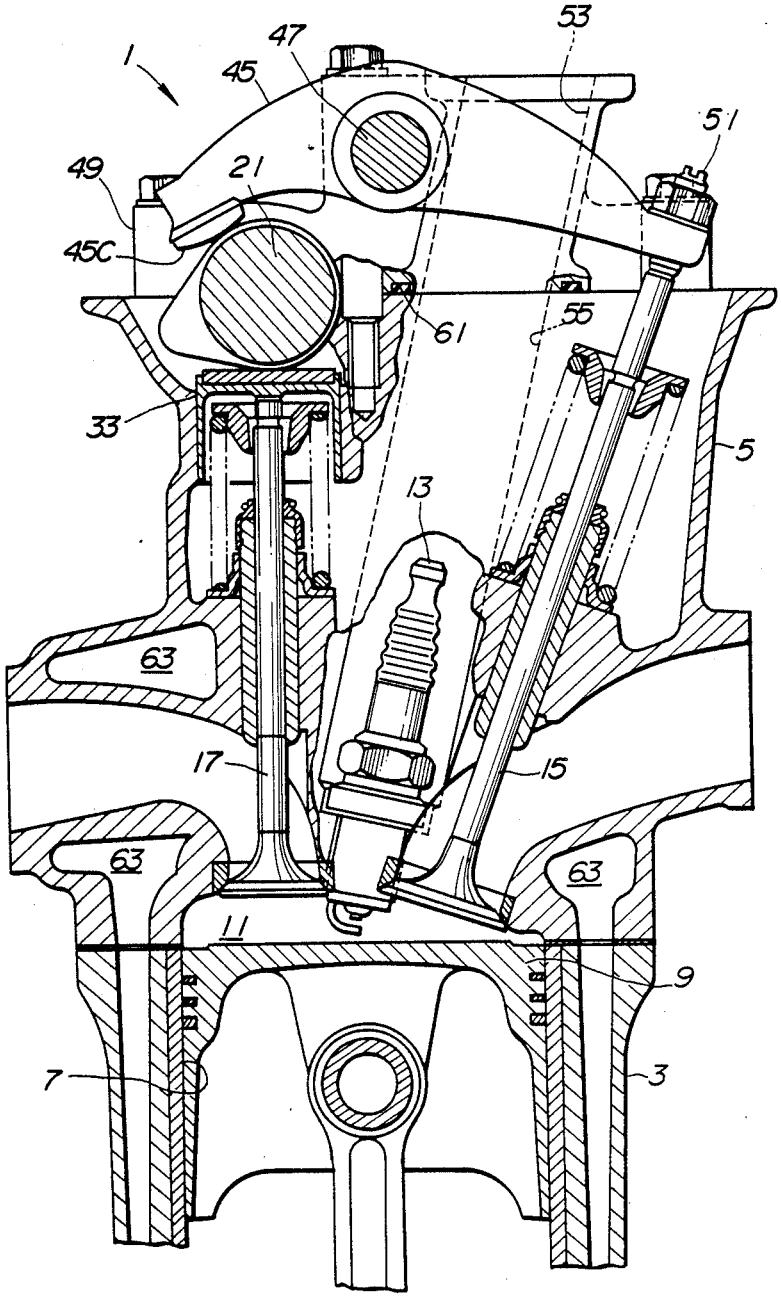
FIG. 5 is a vertical cross-sectional view of an engine cylinder head associated with a valve operating mechanism according to a third embodiment of the present invention.
Figure 6:
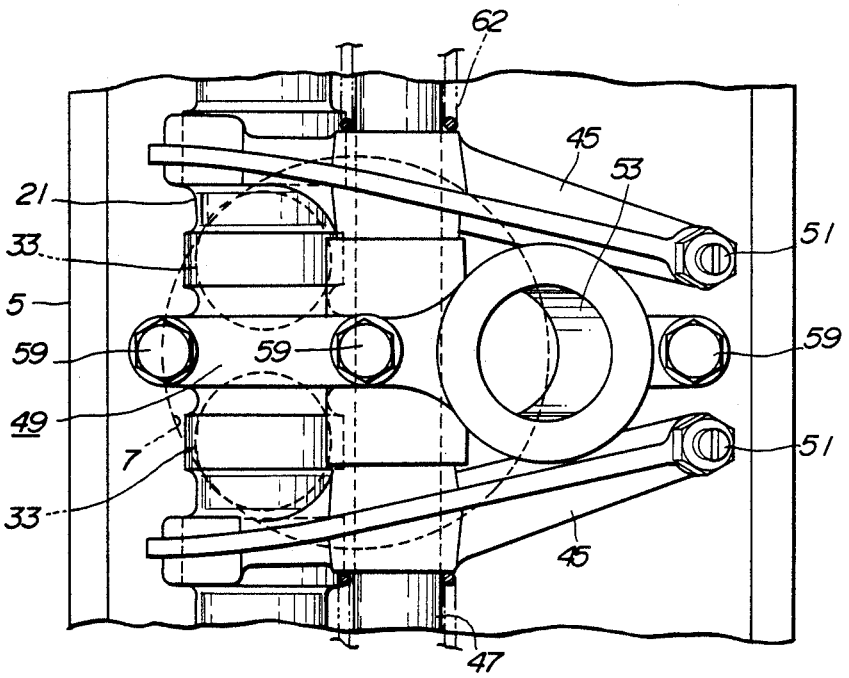
FIG. 6 is a fragmentary plan view of the valve operating mechanism shown in FIG. 5.

A valve operating mechanism according to a third embodiment of the present invention will be described with reference to FIGS. 5 and 6.

The valve operating mechanism of the third embodiment differs from that of the first embodiment in that a single rocker arm shaft 47 is located between the camshaft 21 and the plug insertion hole 53.

In addition to the advantages of the first embodiment, the valve operating mechanism of the third embodiment has another advantage in that the number of parts used is reduced since only one rocker arm shaft 47 is required.

A valve operating mechanism according to a fourth embodiment of the present invention will be described with reference to FIGS. 7 and 8.

Figure 7:
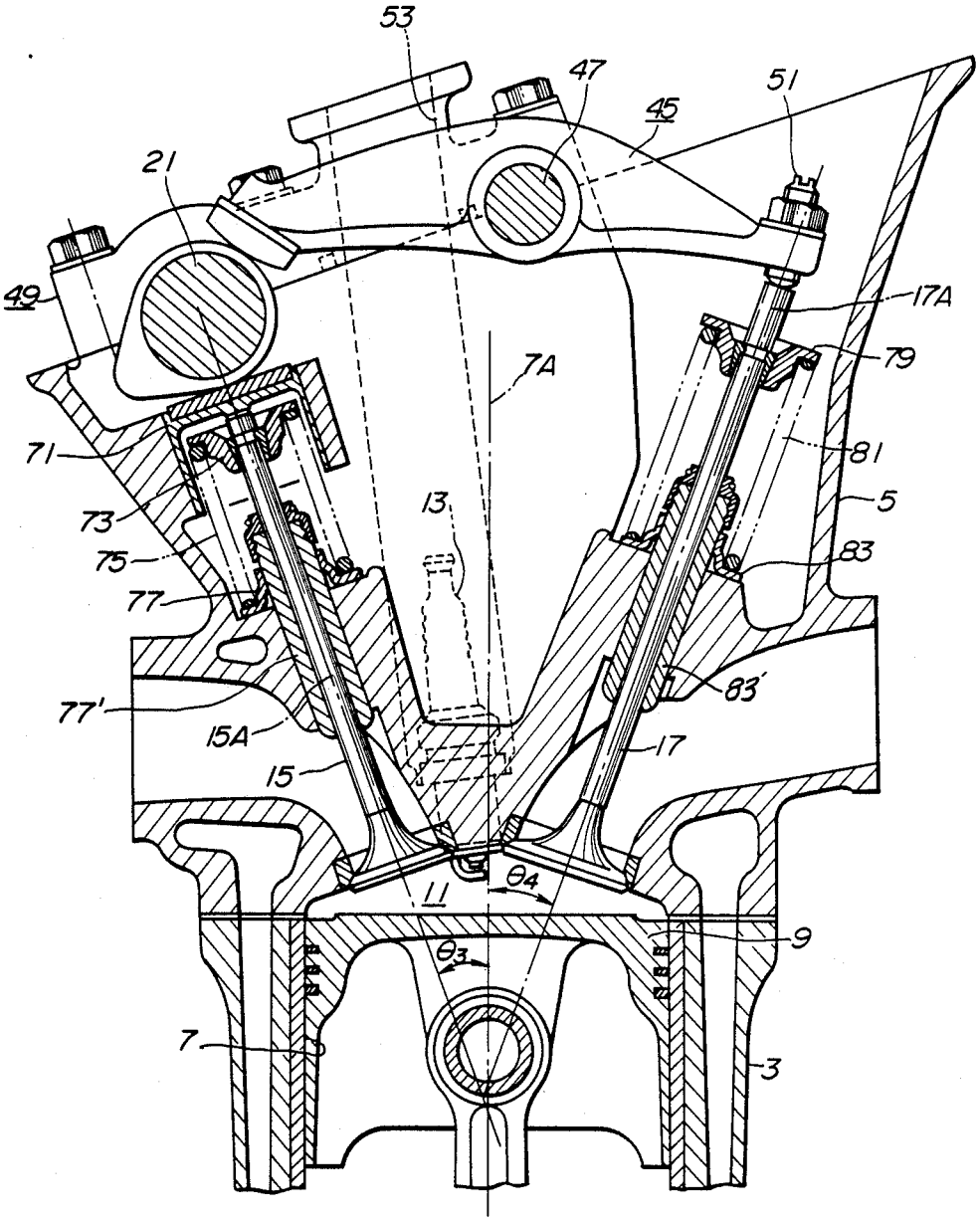
FIG. 7 is a vertical cross-sectional view of an engine cylinder head associated with a valve operating mechanism according to a fourth embodiment of the present invention.
Figure 8:
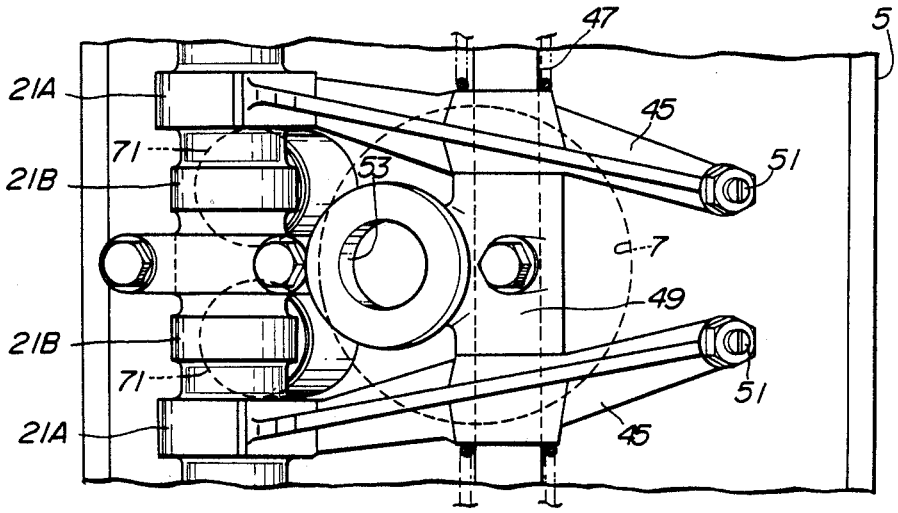
FIG. 8 is a fragmentary plan view of the valve operating mechanism shown in FIG. 7.

As shown in FIG. 7, an intake valve 15 is disposed in one side of the cylinder head 5 and has its axis 15A inclined at an angle $\theta 3$ from the central bore axis 7A. The intake valve 15 is slidably supported by a valve guide 77' and urged by a valve spring 75 held between a spring retainer 73 and a valve seat 77. The intake valve 15 is directly operated by the camshaft 21 through a tappet 71 to open and close the intake port. An exhaust valve 17 is disposed in the opposite side of the cylinder head 5 and has its axis 17A inclined at an angle $\theta 4$ from the central bore axis 7A. The exhaust valve 17 is slidably supported by a valve guide 83' and urged by a valve spring 81 held between a spring retainer 79 and a valve seat 83. The exhaust valve 17 is operated by the camshaft 21 through a rocker arm 45 rotatably supported on a single rocker arm shaft 47 to open and close the intake port. The rocker arm shaft 47 is disposed between the plug insertion hole 53 and the exhaust valve 17.

With the structure of the fourth embodiment, the number of components required is reduced since the single rocker arm shaft 47 is employed as with the third embodiment.

Although there have been described what are at present considered to be the preferred embodiments of the present invention, it will be understood that the invention may be embodied in other specific forms without departing from the spirit or essential characteristics thereof. The present embodiments are therefore to be considered in all aspects as illustrative, and not restrictive. The scope of the invention is indicated by the appended claims rather than by the foregoing description.

We claim:

1. A valve operating mechanism in an internal combustion engine including a cylinder block having a cylinder bore with a central axis, a cylinder head having a combustion chamber communicating with the cylinder bore, a spark plug supported in said cylinder head and having electrodes disposed in said combustion chamber, two exhaust valves supported on said cylinder head and having valve heads disposed in one side of said combustion chamber, and two intake valves supported on said cylinder head and having valve heads disposed in an opposite side of said combustion chamber, said valve operating mechanism comprising:

a camshaft rotatably mounted on said cylinder head and having cams engaging said exhaust valves for operating the exhaust valves;

a rocker arm holder mounted on said cylinder head above said cylinder bore in substantial alignment with the cylinder bore central axis;

a rocker arm shaft means disposed between said camshaft and said intake valves and supported by said rocker arm holder;

two rocker arms swingably mounted on said rocker arm shaft means and each rocker arm having two opposite arm portions extending therefrom with one of said opposite arm portions being held in engagement with a cam on said camshaft and the other of said arm portions being held in engagement with one of said intake valves for operating the intake valve;

said rocker arm holder having a spark plug insertion hole for insertion of said spark plug therethrough for locating the spark plug electrodes substantially at the cylinder bore central axis; and each said exhaust valve having a central axis parallel to the direction of movement of the exhaust valve and parallel to the cylinder bore central axis for locating the exhaust valves and camshaft in close proximity to the cylinder bore central axis and providing a compact exhaust valve arrangement in the engine.

2. A valve operating mechanism according to claim 1 wherein the length of said one opposite arm portion of each rocker arm from said camshaft engagement to said rocker arm shaft means is less than the length of the other said opposite arm portion from said rocker arm shaft to said engagement with the second valve.

3. A valve operating mechanism according to claim 1 wherein the spark plug insertion hole has an axis inclined toward the intake valves.

4. A valve operating mechanism according to claim 3 wherein the rocker arm shaft means is disposed at a level above that of the camshaft.

5. A valve operating mechanism according to claim 1 wherein the two cams for the exhaust valves are closer to the rocker arm holder than the two cams for the intake valves.

6. A valve operating mechanism according to claim 5 wherein the length of said one opposite arm portions of the two rocker arms is longer than the length of said other opposite arm portions of the two rocker arms, the spark plug insertion hole being formed between the other opposite arm portions, and each of the two rocker arms having a straight rib extending entirely from said one opposite arm portions to the other opposite arm portions.

7. A valve operating mechanism according to claim 1, wherein said rocker arm holder is mounted on the cylinder head by a plurality of bolts and each said bolt is parallel to the cylinder bore central axis.

8. A valve operating mechanism according to claim 7, wherein said rocker arm holder has a mounting surface perpendicular to the cylinder bore central axis for engaging the cylinder head when mounted thereon by said bolts.

9. A valve operating mechanism according to claim 7, wherein a central bolt of said plurality of bolts is located between the spark plug insertion hole and a plane through the axes of the two exhaust valves for allowing said central bolt to extend a substantial distance into the cylinder head without interfering with the spark plug insertion hole of an exhaust valve operating mechanism.

10. A valve operating mechanism according to claim 7, wherein a central bolt of said plurality of bolts has a portion intersecting said rocker arm shaft means for preventing rotation and axial movement of said rocker arm shaft means.

11. A valve operating mechanism according to claim 1, wherein an enlarged water jacket passage is located in the cylinder head adjacent to the exhaust valve on the side of the exhaust valve away from the cylinder bore central axis.

12. A valve operating mechanism according to claim 1, wherein each exhaust valve has a smaller valve head and a shorter length than each intake valve for reducing the weight of each exhaust valve.

13. A valve operating mechanism according to claim 12, wherein a valve spring encircles each valve for closing same, and each valve spring encircling an exhaust valve is of a length in the direction of the exhaust valve axis shorter than each valve spring encircling an intake valve.

14. A valve operating mechanism according to claim 1 wherein said rocker arm holder has two opposite bearings, said rocker arm shaft comprising two rocker arm shafts having ends rotatably supported in said bearings, respectively, said spark plug insertion hole being disposed between said bearings.

15. A valve operating mechanism according to claim 1 wherein said rocker arm shaft means comprises a single rocker arm shaft disposed between said spark plug insertion hole and said intake valves.

16. A valve operating mechanism according to claim 1, wherein said camshaft has two cams, one of said cams engaging one of said exhaust valves and one of said rocker arms, and the other cam engaging the other exhaust valve and the other rocker arm.

* * * * *